US009408476B2

(12) United States Patent
Scarleski

(10) Patent No.: US 9,408,476 B2
(45) **Date of Patent: *Aug. 9, 2016**

(54) ACTIVE MATTRESS SPINNER

(71) Applicant: Levitation Sciences LLC, Chicago, IL (US)

(72) Inventor: William John Scarleski, Chicago (IL)

(73) Assignee: Levitation Sciences LLC, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/484,496

(22) Filed: Sep. 12, 2014

(65) Prior Publication Data

US 2015/0000043 A1 Jan. 1, 2015

Related U.S. Application Data

(63) Continuation of application No. 14/015,223, filed on Aug. 30, 2013, now Pat. No. 8,863,326, which is a continuation of application No. 13/360,090, filed on Jan. 27, 2012, now Pat. No. 8,549,681, which is a continuation of application No. 13/078,385, filed on Apr. 1, 2011, now Pat. No. 8,246,706, which is a continuation of application No. 12/772,572, filed on May 3, 2010, now Pat. No. 8,006,331.

(51) Int. Cl.

| | |
|---|---|
| ***A47C 21/06*** | (2006.01) |
| ***A47C 21/02*** | (2006.01) |
| ***A47C 21/00*** | (2006.01) |

(52) U.S. Cl.

CPC ..... *A47C 21/06* (2013.01); *A47C 21/00* (2013.01); *A47C 21/028* (2013.01); *Y10T 29/49826* (2015.01); *Y10T 29/49877* (2015.01)

(58) Field of Classification Search

CPC ..... A47C 21/028; A47C 21/06
USPC ..... 5/81.1 HS, 81.1 RP, 411, 488, 510, 511, 5/659, 925, 926; 414/676

See application file for complete search history.

(56) References Cited

U.S. PATENT DOCUMENTS

| | | | | |
|---|---|---|---|---|
| 5,257,430 | A * | 11/1993 | Yamaguchi | 5/659 |
| 5,313,679 | A * | 5/1994 | Yamaguchi | 5/659 |
| 7,735,164 | B1 * | 6/2010 | Patrick | 5/81.1 HS |
| 8,863,326 | B2 * | 10/2014 | Scarleski | 5/488 |
| 2004/0133978 | A1 * | 7/2004 | Fairchild et al. | 5/488 |
| 2008/0256715 | A1 * | 10/2008 | Jones | 5/659 |
| 2009/0205132 | A1 * | 8/2009 | Amsler, Jr. | 5/246 |
| 2012/0317714 | A1 * | 12/2012 | Matschurek | 5/81.1 RP |

* cited by examiner

*Primary Examiner* — Fredrick Conley

(74) *Attorney, Agent, or Firm* — John S. Paniaguas; Clark Hill PLC

(57) ABSTRACT

A device is disclosed for facilitating rotation of a mattress in a horizontal plane carried by a box spring or a platform. In order to facilitate rotation, slick surfaces between the mattress and the box spring or platform are selectively placed in contact in order to reduce the normal friction therebetween. The slick surfaces may be provided by two (2) separate covers; one cover for the mattress and one cover for the box spring or platform. A first cover is provided with a slick and non-slick surface. In order to further facilitate rotation, a second cover includes a slick surface on one side and forms part of a levitation device. The other side of the second cover may be formed with a slick or a non-slick surface. The levitation device creates an air cushion between the mattress and the box spring under the influence of an air supply which lifts the mattress and allows the mattress to be rotated in a horizontal plane virtually effortlessly. Once the mattress has been rotated to the desired position, the air supply is removed and the first cover is attached to the underside of the mattress so that its non-slick side is in contact with the box spring or platform or bed skirt and its slick side is in contact with the slick side of the other cover and the levitation device defining a normal mode of operation. In a rotate mode of operation, the first cover is attached to the box spring or platform so that its non-slick surface is in contact therewith. Alternatively, the first cover may be integrally incorporated into the box spring or a slick surface may be integrally formed on the platform that forms part of the platform bed. In this embodiment, in order to reduce movement of the mattress with respect to the box spring or platform, the mattress is secured relative to the box spring or platform by removable fasteners in a normal mode of operation. In yet another alternate embodiment of the invention, a portion of the levitation device may be built into the mattress.

3 Claims, 13 Drawing Sheets

ACTIVE MATTRESS SPINNER

CROSS-REFERENCE TO RELATED APPLICATIONS

This application is a continuation of U.S. patent application Ser. No. 14/015,233, filed on Aug. 30, 2013, which, in turn, is a continuation of U.S. patent application Ser. No. 13/360,090, filed on Jan. 27, 2012, now U.S. Pat. No. 8,549,681, which, in turn, is a continuation of U.S. patent application Ser. No. 13/078,385, filed on Apr. 1, 2011, now U.S. Pat. No. 8,246,706, which, in turn, is a continuation of U.S. patent application Ser. No. 12/772,572, filed on May 3, 2010, now U.S. Pat. No. 8,006,331.

BACKGROUND OF THE INVENTION

1. Field of the Invention

The present invention relates to a system for facilitating the rotation of a top mattress in a horizontal plane with respect to a box spring or lower mattress or platform and more particularly to a system which allows rotation of a top mattress in a horizontal plane with minimal effort in order to relocate worn or depressed portions of the mattress in order to even out the overall wear of the mattress.

2. Description of the Prior Art

A conventional bed includes a box spring or bottom mattress or platform and an upper mattress. The box spring is normally carried by a bed frame which, in turn, carries a top mattress, which ends up being suspended about 13-16 inches from the floor. The top mattress (hereinafter "mattress") may be placed on top of the box spring or alternatively placed upon a platform forming a platform bed. In both applications, the mattress is held in place by friction and its weight.

Various types of mattresses are known. For example, U.S. Pat. Nos. 7,617,556 and 7,644,671 disclose conventional mattresses. Such conventional mattresses include a "casing" which is formed from material for holding the internal components of the mattress. The casing includes a bottom panel and four (4) vertical panels connected to the periphery of the bottom panel forming an open top container. In one such conventional mattress, a spring core is disposed in the container and rests against the bottom floor and fits snugly against the vertical panels. One or more layers of foam padding is placed on top of the spring core and covered with a top cover which is secured to the vertical panels.

In other known mattresses, a foam core is used in place of the spring core. Other known mattresses are known to include a so-called "pillow-top". The pillow top is generally formed as a comforter secured to the top cover and filled with cotton or some type of fibrous material.

A problem with the various types of mattresses, as discussed above, is that over time the mattress materials lose their resiliency causing body depressions to develop. In order to even out the wear in the mattress, it is known to rotate the mattress in the horizontal plane to relocate the body depressions, as shown for example, in FIGS. 1 and 2. Depending on the size of the mattress, one or two people may be required to rotate the mattress. For example, king and queen size mattresses may likely require two people to rotate the mattress, as shown in FIG. 1, while full and twin size mattresses can likely be rotated by a single person, as shown in FIG. 2.

Mattresses are relatively heavy items. The weight of a mattress varies as a function of the coil core, the gauge of the coil and the type of foam material used. An average king size mattress weighs between 85 and 115 pounds. High end king size mattresses with latex or memory foam can weigh as much as 300 pounds (http://www.mattressdirectonline.com).

In order to rotate a mattress, the mattress must first be lifted and then rotated, As such, rotating a mattress is hard work. Depending on the weight of the mattress, rotating a mattress can be virtually impossible for some people, such as senior citizens, as well as people that are handicapped or disabled and others.

In order to address this problem, mattresses with removable pillow tops have been developed. An example of such a mattress is disclosed in U.S. Pat. No. 5,414,882. The '882 patent discloses a mattress with a pillow top that is secured to the top cover of the mattress by way of a zipper. With such a configuration, the pillow top can be relatively easily rotated by unzipping the pillow top, rotating it and zipping the pillow top back in place. While such a configuration enables body depressions in the pillow top to be relocated, it has no affect on body depressions that result in the mattress itself. Thus there is a need for a system to facilitate rotation of a mattress.

SUMMARY OF THE INVENTION

Briefly, the present invention relates to a device for facilitating rotation of a mattress in a horizontal plane carried by a box spring or a platform. In order to facilitate rotation, slick surfaces between the mattress and the box spring or platform are selectively placed in contact in order to reduce the normal friction therebetween. The slick surfaces may be provided by two (2) separate covers; one cover for the mattress and one cover for the box spring or platform. A first cover is provided with a slick and non-slick surface. In order to further facilitate rotation, a second cover includes a slick surface on one side and forms part of a levitation device. The other side of the second cover may be formed with a slick or a non-slick surface. The levitation device creates an air cushion between the mattress and the box spring under the influence of an air supply which lifts the mattress and allows the mattress to be rotated in a horizontal plane virtually effortlessly. Once the mattress has been rotated to the desired position, the air supply is removed and the first cover is attached to the underside of the mattress so that its non-slick side is in contact with the box spring or platform or bed skirt and its slick side is in contact with the slick side of the other cover and the levitation device defining a normal mode of operation. In a rotate mode of operation, the first cover is attached to the box spring or platform or bed skirt so that its non-slick surface is in contact therewith. Alternatively, the first cover may be integrally incorporated into the box spring or a slick surface may be integrally formed on the platform that forms part of the platform bed. In this embodiment, in order to prevent movement of the mattress with respect to the box spring or platform, the mattress is secured relative to the box spring or platform by removable fasteners in a normal mode of operation. In yet another alternate embodiment of the invention, a portion of the levitation device may be built into the mattress.

DESCRIPTION OF THE DRAWING

These and other advantages of the present invention will be readily understood with reference to the following specification and attached drawing wherein.

DETAILED DESCRIPTION

The present invention relates to device for facilitating rotation of a mattress in a horizontal plane carried by a box spring or a platform. A first embodiment of the invention is illustrated in FIGS. 5-8. In this embodiment of the invention, in order to facilitate rotation of the mattress with respect to the box spring, slick surfaces between the mattress and the box spring or platform are selectively placed in contact in order to reduce the normal friction therebetween. The slick surfaces are provided by two (2) separate covers; a first cover for the box spring or platform and a second cover for the mattress. The first cover is provided with a slick surface and non-slick surface. In order to further facilitate rotation, a second cover includes a slick surface on one side which also includes part of a levitation device. The other side of the second cover may be formed with a slick or a non-slick surface. The levitation device creates an air column or cushion between the covers on the mattress and the box spring under the influence of an air supply which lifts the mattress and allows the mattress to be rotated in a horizontal plane virtually effortlessly. Once the mattress has been rotated to the desired position, the air supply is removed and the first cover is attached to the underside of the mattress so that its non-slick side is in contact with the box spring or platform or bed skirt and its slick side is in contact with the slick side of the other cover and the levitation device defining a normal mode of operation.

In a rotate mode of operation, the first cover is attached to the box spring or platform or bed skirt so that its non-slick surface is in contact therewith. Alternatively, as illustrated in FIGS. 16-23, the first cover may be integrally incorporated into the box spring or a slick surface may be integrally formed on the platform that forms part of the platform bed. In that embodiment, in order to prevent movement of the mattress with respect to the box spring or platform, the mattress is secured relative to the box spring or platform by removable fasteners in a normal mode of operation, as shown in FIGS. 19-23.

Figure 5:
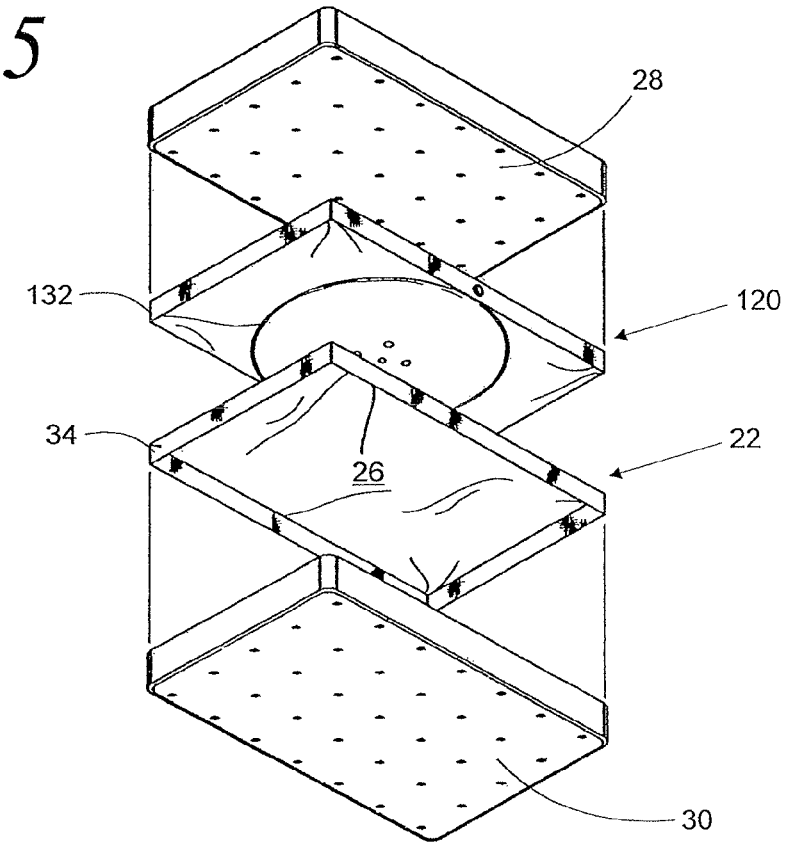
FIG. 5 is an exploded isometric view of one embodiment of the invention illustrating a conventional box spring and a conventional mattress and two covers in accordance with the present invention, shown with a portion of the levitation device integrated into one cover.
Figure 6:
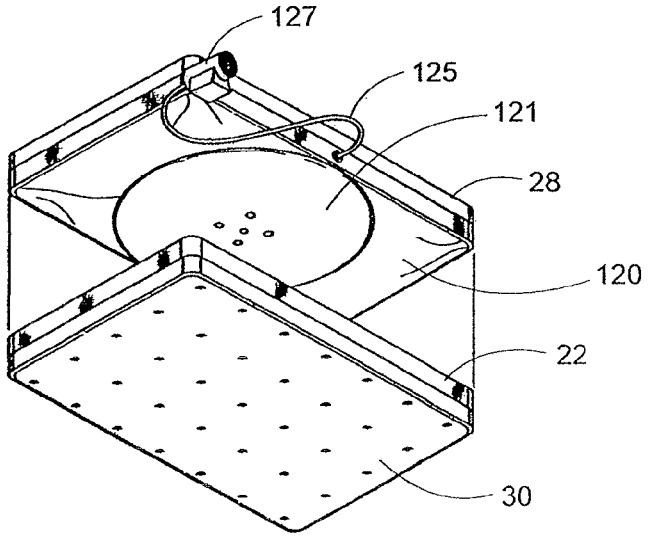
FIG. 6 is similar to FIG. 5 illustrating one of the covers shown in FIG. 5 installed on the mattress and one cover installed on the box spring.
Figure 7:
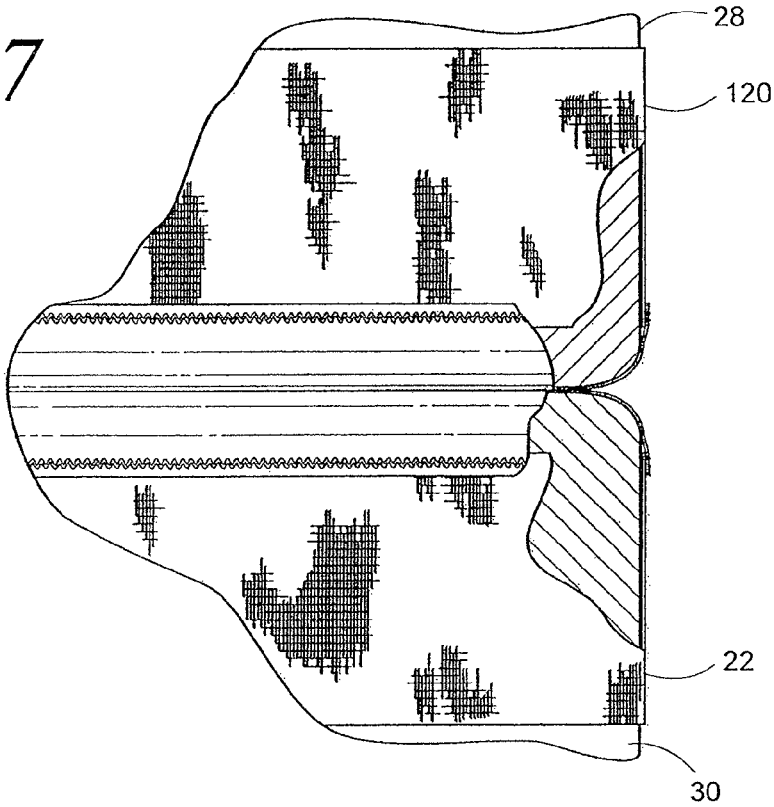
FIG. 7 is a partial side elevational view of the embodiment illustrated in FIG. 5, partially in section, illustrating one of the covers installed on the mattress and one cover installed on the box spring and shown in a rotate configuration in which the slick surfaces of the two covers are in contact with each other.
Figure 8:
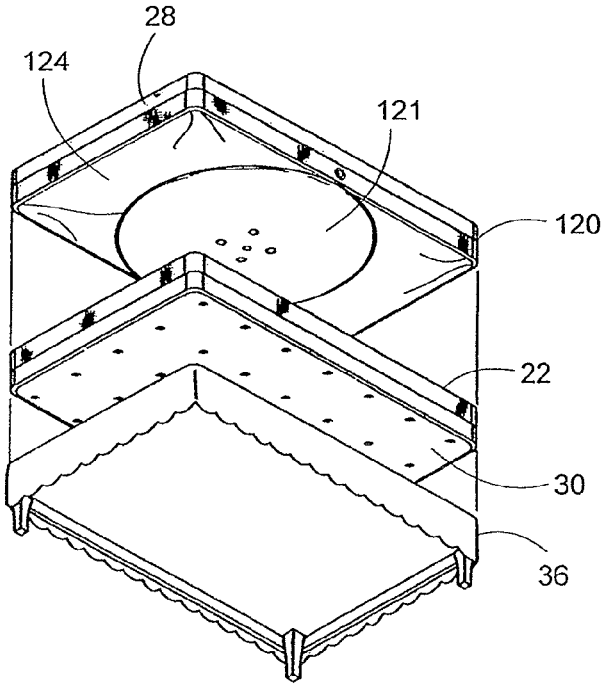
FIG. 8 is an exploded isometric view of an application of the invention illustrated in FIGS. 5-7 in which the bottom cover is to be placed over a bed skirt on the box spring securing it in place.

As best shown in FIG. 5, the first cover, identified with the reference numeral 22 includes a rectangular panel 26, configured to the size of a box spring 30. The cover 22 includes a stretchable band 34, attached to the periphery of the panel 26. The band 34, allows the cover 22 to be removably secured to the box spring 30, as generally shown in FIG. 6.

Figure 3:
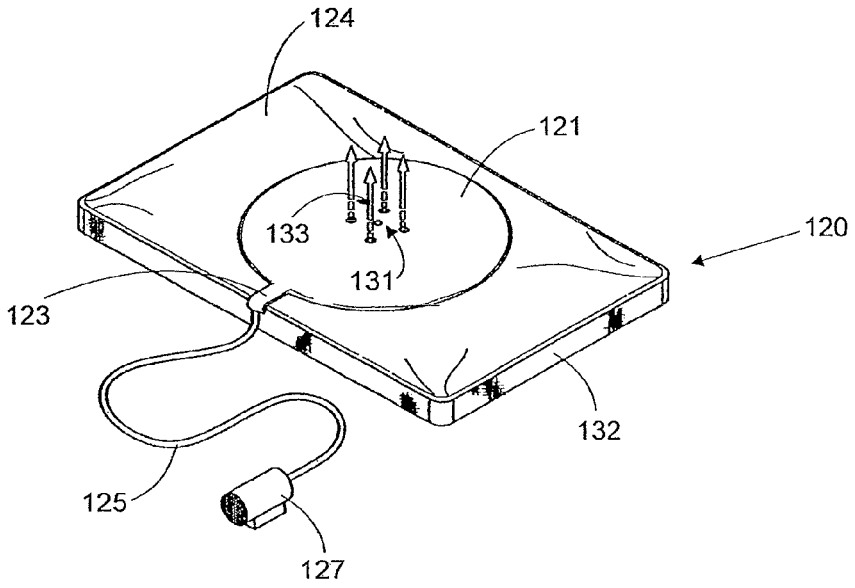
FIG. 3 is an isometric view of a levitation device for use with the present invention shown partially integrated onto a slick side of a cover.
Figure 4:
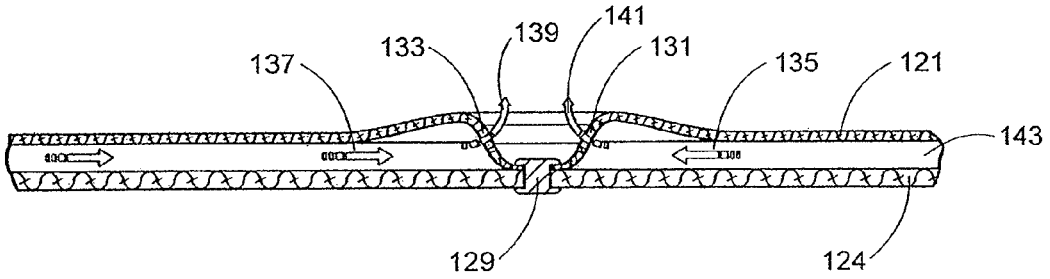
FIG. 4 is an elevational view of a portion of the levitation device illustrated in FIG. 3.

The second cover, as best illustrated in FIGS. 3 and 4 and generally identified with the reference numeral 120, includes a panel 124, configured to the size of a mattress 28. The cover 120 includes a stretchable band 132, attached to the periphery of the panel 124. The band 132, allows the cover 120 to be removably secured to the underside of the mattress 28, as generally shown in FIG. 6.

The panel 124 and the band 132 portion of the cover 120 are similar to the cover 22 except that the cover 120 additionally includes an integrally formed levitation device. More particularly, an expandable air volume or bladder is formed in a portion of the cover 120. The expandable volume may consist of a top layer 121 being secured, for example, by sewing or other means, over a portion of the panel 124. As shown, the top layer 121 may be formed from the same material as the panel 124 and formed in a circular shape and generally centrally located with respect to the cover 120. The top layer 121 and the panel 124 are formed with a slick surface facing outwardly. The other side of the cover 120 may be formed with either a slick surface or a non-slick surface.

Figure 1:
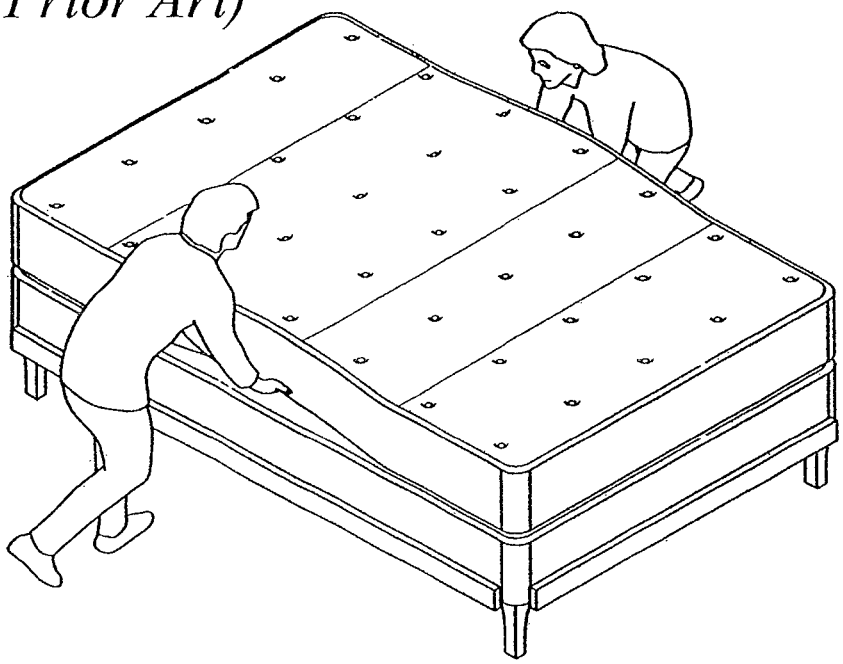
Fig. 1 (Prior Art)
FIG. 1 is an isometric drawing illustrating two people lifting a conventional mattress carried by a box spring in an attempt to rotate the mattress in a horizontal plane.
Figure 2:
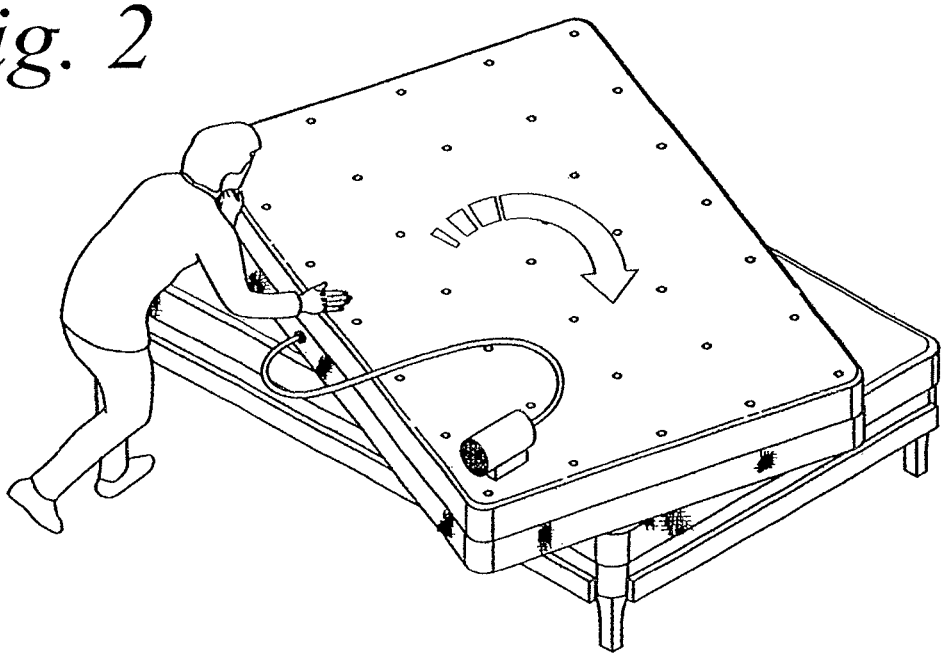
FIG. 2 is an isometric view of one person rotating a conventional mattress carried by a box spring incorporating the present invention, shown with the mattress partially rotated.

The expandable volume includes an air intake nozzle 123 (FIG. 3) and a plurality of air discharge holes, generally identified with the reference numerals 131 and 133. A grommet 129 or other fastening means to attach a center point of the top cover 121 to the panel 124, such as heat sealing, stitching, glue or the like, may be centrally located with respect to the top layer 121 and used to secure a one point on the top cover 121 to the panel 124 and create the air channels, identified by the reference numeral 143 to create the air flow as illustrated by the arrows 135 and 137 from the nozzle 123 to the discharge holes 131 and 133. As shown in FIG. 4, once air is applied to the air intake nozzle 123, the top cover 121 is raised as shown and an air column to be formed adjacent the grommet 129. The air column lifts or levitates the center portion of the mattress 28 by way of an air cushion. In as much as the slick surface of the cover 22 is in contact with the slick surfaces of the top cover 121 and the slick surface of the panel 124, the mattress 28 is virtually effortlessly rotated, as generally illustrated in FIG. 2.

The bands 132 and 34 (FIGS. 3 and 5) may be formed from an elastic material, for example, spandex and other stretchable materials, such as mesh or an elastic bandina and attached to the panels 124 and 26 respectively, for example, by sewing. Alternatively, the bands 32, 34 can be formed from a mesh or stretchable fabric. The bands 132 and 34 can be formed from the same material as the panels 24, 26 and secured to the mattress 28 and box spring or platform 30 by way of a drawstring (not shown) or other attachment method.

Figure 28A:
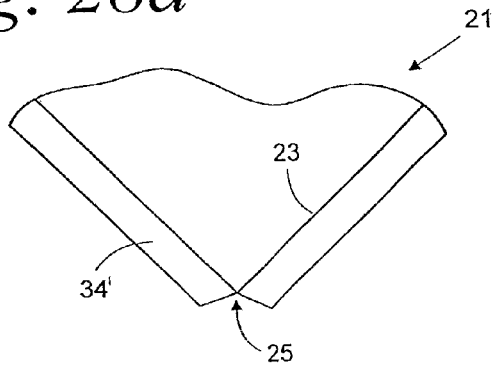
FIG. 28*a* is a partial isometric view of a material blank for use as a cover with the present invention, shown with fold lines on adjacent edges and an obtuse angle cut-out at one corner.
Figure 28B:
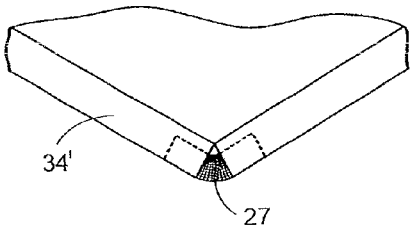
FIG. 28*b* is similar to FIG. 28*a* but illustrating an elastic material joining the strips defined by the fold lines and bridging the cut-out.

The bands 132 and 34 may also be formed by less labor intensive methods, as illustrated in FIGS. 28*a*-28*b* and FIGS. 29*a*-29*c*. The methods illustrated in these figures, reduce the amount of sewing and thus the labor involved. For simplicity, only one cover 22 is described and illustrated. However, these teachings also apply to the band 132 and panel 124 of the cover 120. Referring first to FIGS. 28*a* and 28*b*, one corner of a cover blank, generally identified with the reference numeral 21, is illustrated for simplicity. The cover blank 21 is formed as a generally rectangular piece of material with fold lines, generally identified with the reference numeral 23, adjacent to each edge of the rectangular piece of material. As shown in FIG. 28*a*, a piece of material is cut out of each corner defining, for example, an obtuse angle. The cut-out is identified with the reference numeral 25. The bands 34' are folded down as shown in FIG. 28*b*. A piece of flexible material, such as elastic, identified with the reference number 27, is used to bridge the cut-out 25. The flexible material 27 is secured to the ends of the contiguous bands 34'. As will be appreciated by those of ordinary skill in the art, the embodiment illustrated in FIGS. 28*a* and 28*b* significantly reduces the labor costs.

Figure 29A:
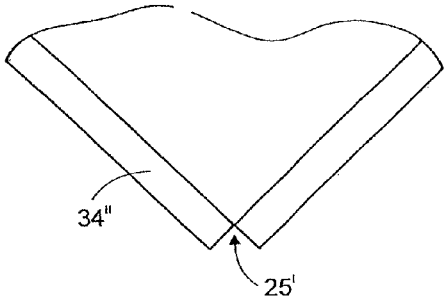
FIG. 29*a* is similar to FIG. 28*a* but illustrates a cut-out at other than an obtuse angle.
Figure 29B:
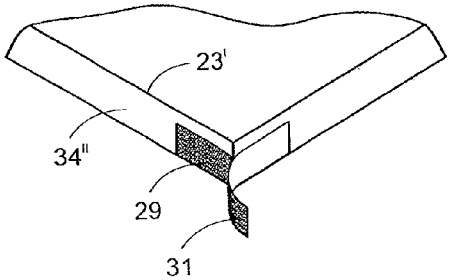
FIG. 29*b* illustrates the material blank illustrated in FIG. 29*a* with an integrated fastener strip on the strips defined by the fold lines shown with a cooperating removable fastener strip partially attached to the integrated fastener strip.
Figure 29C:
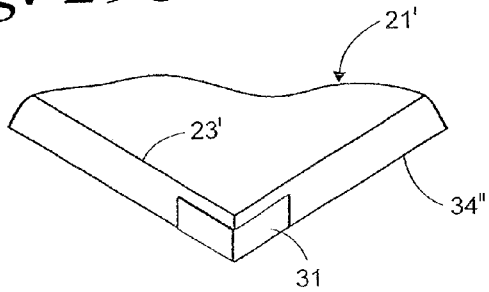
FIG. 29*c* is similar to FIG. 29*b* but shown with the removable fastener strip completely attached to the integrated fastener strip.

A second technique to reduce labor costs is illustrated in FIGS. 29*a*-29*c*. In this embodiment, the corners of the material blank 21' are cut to form a cut-out 25' that is not an obtuse angle. The exemplary cut-out 25' is shown at roughly a 90 degree angle. In this embodiment, a fastener strip 29 is affixed to each end of the band 34", adjacent the cut-out 25'. A cooperating removable fastener strip 31 may be attached to the fastener strips 29 to secure the adjacent bands 34" together. The fastener strips 29 and 31 may be Velcro or other type of fastener. The embodiment illustrated in FIGS. 29*a*-29*c* allows the material blank 21' to be juxtaposed over the mattress 28 or box spring 30 with the removable fastener strips 31, as least partially removed, for example, as shown in FIG. 29*b*. and secured to the exposed cooperating fastener strip 29, once the cover 20 is in place, as shown in FIG. 29*c*.

In accordance with an important aspect of the invention, the cover 22 has a "slick" side having a relatively low co-efficient of friction and a non-slick side having a relatively higher co-efficient of friction. The other cover 120 which includes a portion of the levitation device has at least one slick side and may have two slick sides. As such, when the slick surfaces of the two covers 120 and 22 are selectively placed in contact with each other, the mattress 28 can be rotated in a horizontal plane with minimal effort by one person in a configuration defining a rotate mode of operation, as discussed in more detail below. The non-slick side of the cover 22 is used to selectively be placed in contact with an uncovered surface of the box spring 30. The non-slick side provides a the uncovered surface of the box spring 30, platform or bed skirt 36 in order to reduce if not prevent unintended rotation of the mattress in a normal configuration.

Various materials, such as cloth, and other materials that are bendable and amenable to being folded and stored in relatively small packages, are suitable for the panels 24, 26 for the covers 20, 22. The material for one cover 20, 22 need only have a slick side and a non-slick side. The non-slick side can be created on one side of a slick material by way of a coating or sewing or fusing a non-slick backing to one side of the non-slick material. Various conventionally available materials are suitable for the cover having a slick side and a non-slick side. For example, "20 Denier Heat Sealable (backside) 100% Nylon Rip Stop" material is suitable for use with the present invention or other materials with similar coefficients of friction on the slick and non-slick sides. Such material may be nylon, for example, 100% nylon with a coating on one side, for example, urethane or other thermal plastic or heat sealable coating Such nylon rip stop material is known to come in widths of 58-62 inches wide and weighs about 1.9 to 4.4 ounces per square yard. Such material can easily be pieced together to accommodate various mattress widths if necessary.

Nylon rip stop material suitable for use with the-present invention is available from various sources, such as, Quest Outfitters of Sarasota, Fla. (http://questoutfitters.com). Their nylon taffeta material is described in detail at http://questoutfitters.com/coated.html#HEAT SEALABLE, hereby incorporated by reference. Suitable nylon taffeta material is also available from Rockywoods in Loveland, Colo. (http://www.rockywoods.com). Their nylon taffeta material is described in detail at http://www.rockywoods.com/Fabrics-Hardware-Patterns-Kits/Medium-Weight-Nylon-Fabrics/Heat-Sealable-70-Denier-Nylon-Taffeta, hereby incorporated by reference.

Non-woven materials may also be used for the cover 20, 22 having a slick side and a non-slick side. For example, Tyvek® polyethylene non-woven fabric, as manufactured by the DuPont Corporation and described in detail at http://www2.dupont.com/Products_and_Services/en_VN/nwn.html may be used. Other materials having two slick sides can also be used, such as, silicone impregnated nylon rip stop, for example, as available from Seattle Fabrics, Inc., http://www.seattlefabrics.com/nylons.html. Other materials can also be used with a coating applied to one side. Moreover, different materials can be used for each cover in an application.

Referring first to FIGS. 5-8, a first cover 22 is attached to a box spring 30 so that its non-slick side is in contact with the box spring 30 and its slick side is facing upwardly. The second cover 120 which includes a portion of the levitation device is attached to the underside of a mattress 28. In a rotate mode of operation, the cover 22 is attached to the box spring 30 so that its rough side is in contact with the box spring 30 and its slick side is facing upwardly so that its slick side is in contact with the slick surfaces 121 and 124 of the cover 120. In a normal mode of operation, the cover 22 is attached to the mattress 28 so that its rough side contacts the box spring 28 and its slick side contacts the slick surfaces 121 and 124 of the cover 120, thereby reducing unintended movement of the mattress 28 relative to the box spring 30 or bed skirt 36 or platform.

A small air supply 127 is connected to the air intake nozzle 123 by way of a conduit 125, as generally shown in FIG. 3. Since the force required to lift the mattress 28 is proportional to the pressure multiplied by the area of the mattress 28, the area of the top cover 121 may be divided into the total weight of the mattress 28 the amount of pressure required by the air pump 160. AS shown, the diameter of the top cover 121 may be selected to be slightly less than the width of the mattress 28, as shown, for example, in FIG. 3.

Figure 14:
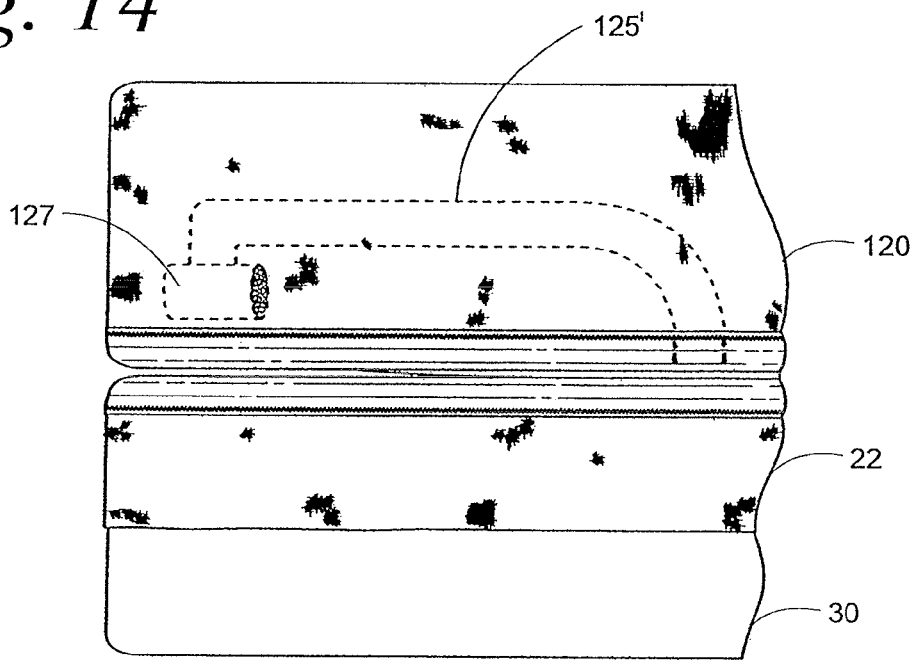
FIG. 14 illustrates an alternative embodiment of the system illustrated in FIG. 2 which includes an internal air pump built into the mattress, also illustrating the air conduit for supplying to an expandable air volume which forms a portion of the levitation device.
Figure 15:
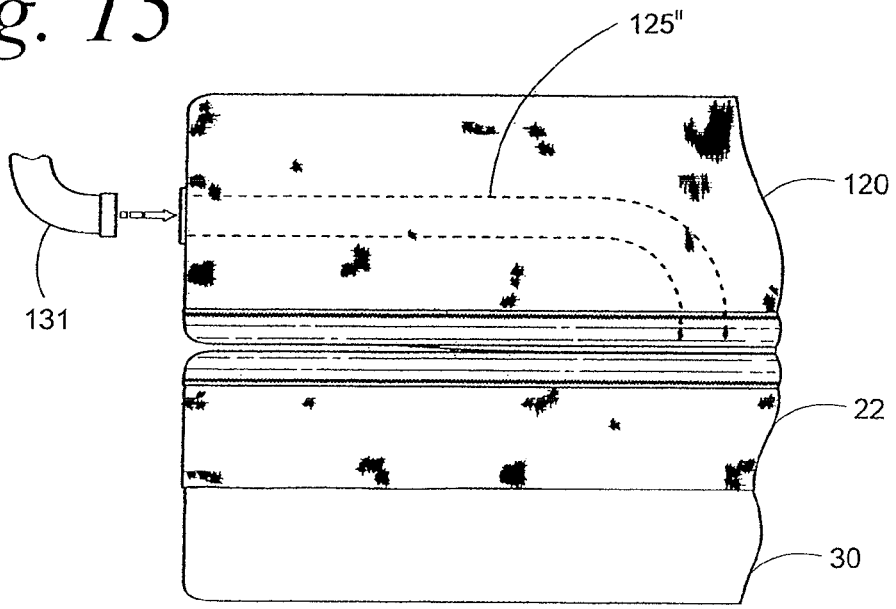
FIG. 15 is similar to FIG. 14 but illustrating an embodiment with an external air pump.
Figure 16:
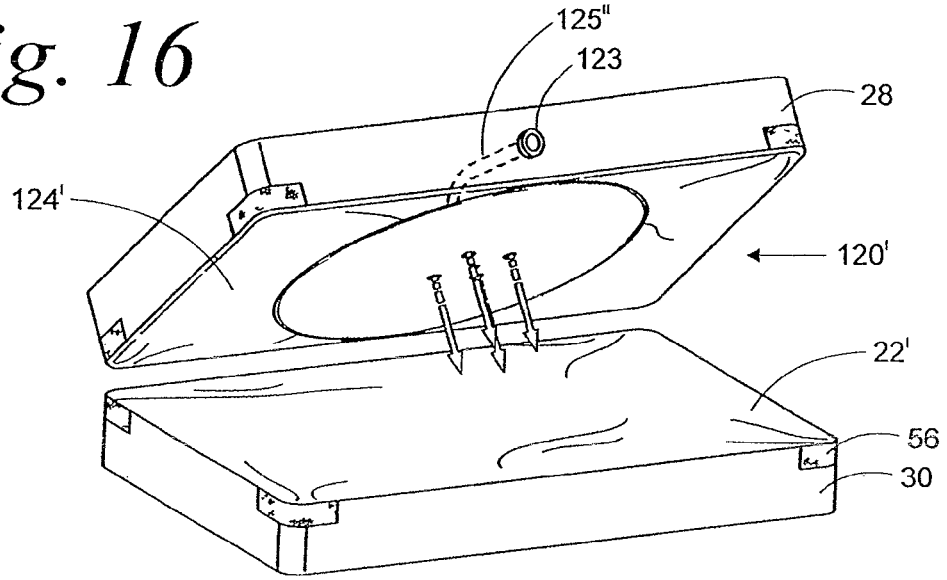
FIG. 16 is an alternate embodiment of the invention in which slick surfaces are integrated into the mattress and box spring along with a portion of the levitation device, shown with the mattress removed from the box spring and fastener strips integrated into the corners of the mattress and box spring.

An alternate embodiment of the invention is illustrated in FIGS. 14 and 15. In this embodiment, a conduit 125' between the air intake nozzle 123 (FIG. 3) and the air pump 127 may be partially incorporated into the mattress 28. FIG. 16 illustrates yet another alternate embodiment in which includes an embedded conduit 125" the mattress 28 in that is in fluid communication with the interior of the expandable volume and is connected to the air supply pump 127 (FIG. 3) external to the cover 120 by way of a connector 131.

Figure 9:
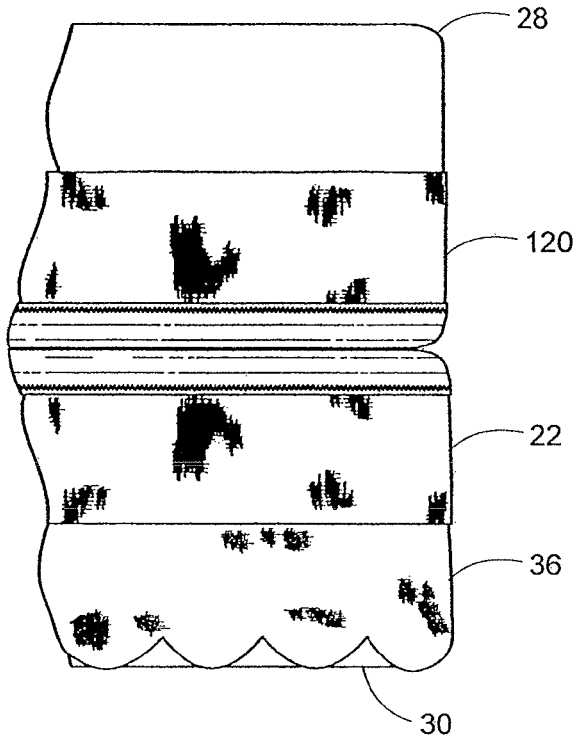
FIG. 9 is a partial side elevational view of the embodiment illustrated in FIG. 8, shown with one of the covers installed on the mattress and the other cover installed on the box spring illustrating a rotate configuration in which both slick surfaces are in contact with each other.

FIGS. 9-13 illustrate one application of the covers 120 and 22 in which a bed skirt 36 is draped over the box spring 30, as generally shown in FIG. 9. Heretofore rotation of a mattress 28 with a bed skirt 36 draped over the box spring 30 was a relatively cumbersome task. The present invention greatly simplifies rotation of the mattress 28 in such an application. More specifically, in this application, the cover 120 is attached to the underside of the mattress 28 so that its non-slick side or non-slick side, i.e side not including the top cover 121, is in contact with the mattress 28 and its slick side, i.e. side including the top cover 121, is facing downward. The other cover 22 is attached to the box spring 30 over the bed skirt 36 so that its non-slick side is in contact with the bed skirt 36 and its slick side is facing upward, thereby placing the slick sides of the covers 120 and 22 in contact with each other, as shown in FIG. 9. The mattress 28 can then be rotated virtually effortlessly, as generally illustrated in FIG. 2.

Figure 10:
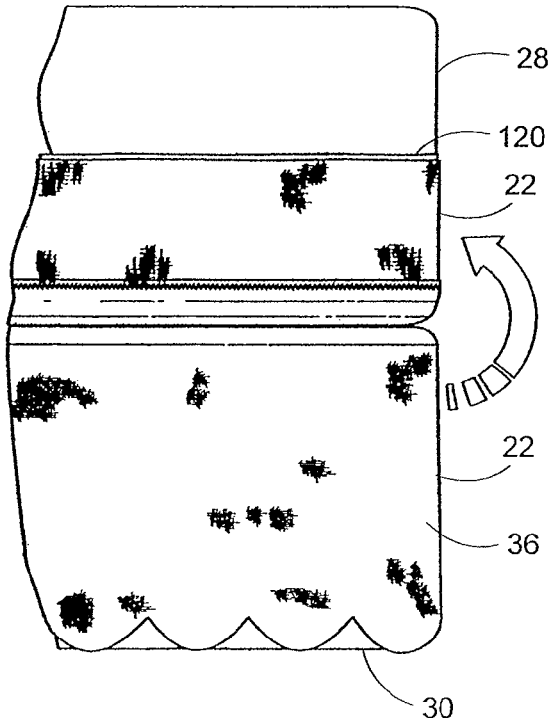
FIG. 10 is similar to FIG. 9 but shown with both covers installed on the mattress, illustrating a normal configuration in which a non slick surface of the bottom cover is in contact with the surface of the bed skirt.

After the mattress 28 is rotated to the desired position, the cover 22 is detached from the box spring 30 and attached to the mattress 28 over the cover 120, as shown in FIG. 10. This places the non-slick side of the cover 22 in contact with the bed skirt 36 to reduce if not prevent unintended rotation of the mattress 28. As shown in FIG. 10, the bed skirt 36 is uncovered and undisturbed since the cover 22 holds the bed skirt 36 in place during the rotation of the mattress 28.

Figure 11:
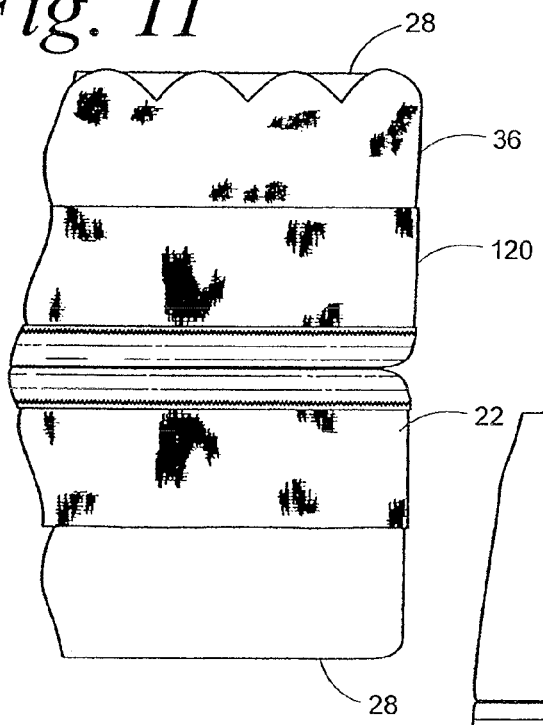
FIG. 11 is an alternative application of the embodiment illustrated in FIGS. 8-10 in which the bed skirt is used to hide both covers in a normal configuration, shown in a rotation configuration.
Figure 12:
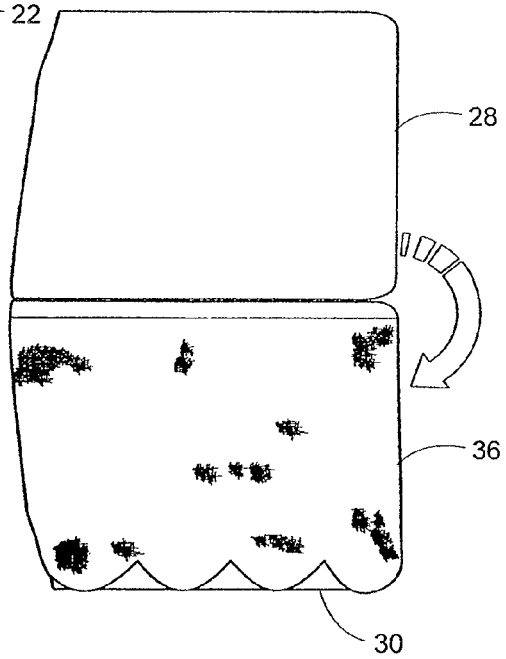
FIG. 12 is a partial elevational view of the application illustrated in FIG. 11 in a normal configuration in which the bed skirt is pulled down over the box spring hiding both of the covers.
Figure 13:
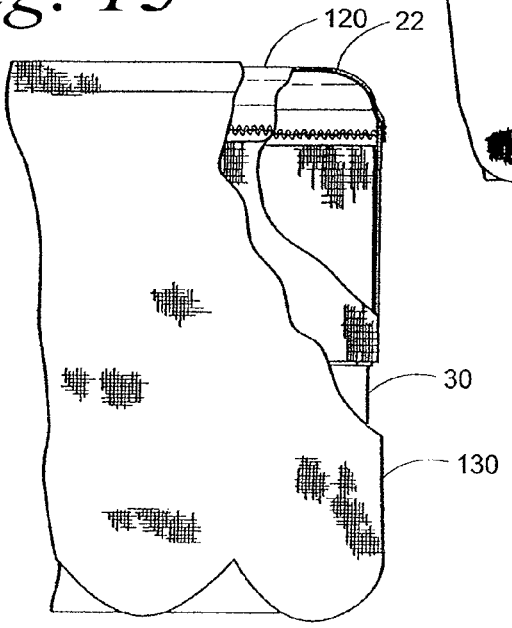
FIG. 13 is a partial elevational view of the box spring illustrated in FIG. 10, partially in section, shown in a normal configuration.

FIGS. 11-13 are similar to FIGS. 9 and 10 and illustrate another application in which the bed skirt 36 is used to hide the covers 120 and 22 in a normal configuration. Referring to FIG. 11, the bed skirt 36 is disposed around the mattress 28 so that its finished side is in contact with the mattress 28 and its unfinished side is facing outwardly. The cover 120 is attached to the mattress 28 over the bed skirt 36 so that its non-slick side is in contact with the bed skirt 36 and its slick side is facing downwardly. The other cover 22 is attached to the box spring 30 so that its non-slick side is in contact with the box spring 30 and its slick side is facing upwardly, thus placing the slick sides of the covers 120 and 22 in contact with each other. The mattress 30 can then be rotated in a horizontal plane virtually effortlessly by one person. Once the mattress 28 is in the desired position, the cover 120 is detached from the mattress 28 and attached to the box spring 30, over the other cover 22. This places the non-slick side of the cover 120 in contact with the mattress 28, thereby reducing unintended rotation of the mattress 28. Once the cover 120 is attached to the box spring 30, the bed skirt 36 is folded down over the box spring 30, thereby hiding both the first and second covers 20 and 22, as shown in FIGS. 12 and 13.

Figure 24:
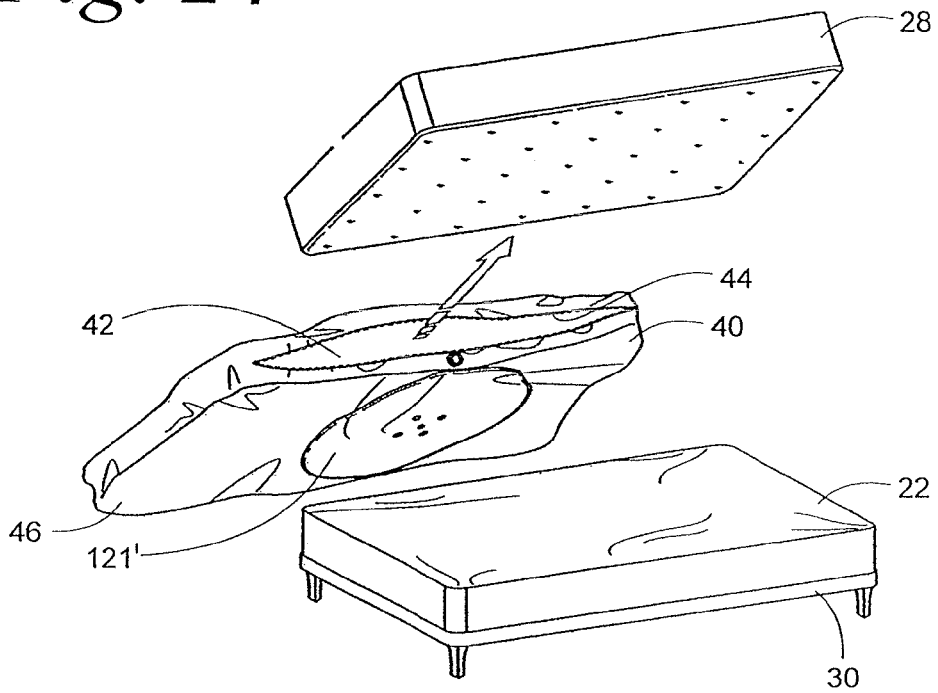
FIG. 24 illustrates an alternate embodiment of the invention in which the mattress cover is a protective cover having at least one slick surface, shown with the protective cover removed from the mattress and the mattress suspended relative to the box spring.
Figure 25:
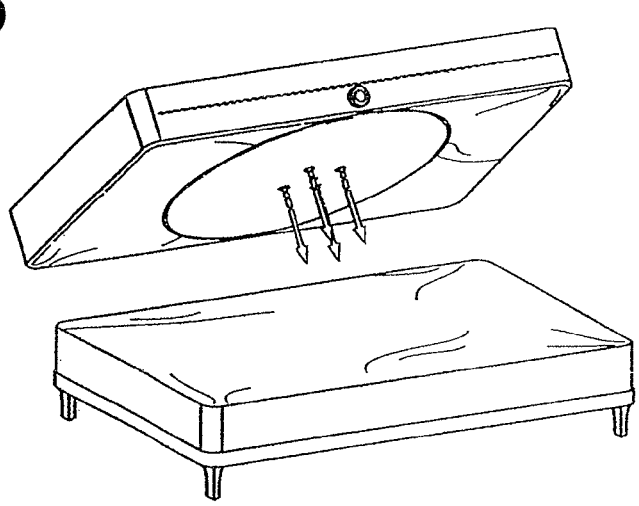
FIG. 25 is similar to FIG. 24 but shown with the protective cover installed on the mattress.

FIGS. 24 and 25 illustrate an embodiment in which the cover 120 is replaced with a protective cover 40, such as a waterproof cover, that encapsulates the mattress 28. The cover 40 is formed with a portion of the levitation device, as illustrated in FIG. 24 and discussed above. The protective cover 40 is to size and shape of the mattress 28 to provide a relatively snug fit. An opening 42 is provided along one edge of the protective cover 40 to enable the mattress 28 to be placed inside the protective cover 40 so that the levitation device is facing downwardly. A conventional fastener, such as a zipper 44 may be used to close the opening 42. In this embodiment, one surface 46 of the cover 40 is provided with a slick surface 46 as is the top cover 121' of the levitation device.

With reference to FIGS. 5-8, The mattress 28 and the cover 40 are configured so that the slick surface 46 faces the box spring 30. The cover 22 is formed with a slick surface and a non-slick surface. The cover 22 is attached to the box spring 30 so that its non-slick side is in contact with the box spring 30 and its slick side is facing upwardly. The slick side 46 of the cover 40 cooperates with the slick side of the cover 22 to facilitate rotation of the covered mattress 28 in a rotate mode.

The cover 22 is as described above with a slick surface and a non-slick surface. More particularly, in a rotate mode of operation, the cover 22 is attached to the box spring 30 so that its non-slick surface is in contact with the box spring 30 and the slick surface faces upwardly in order to contact the slick surface of the protective cover 40. In this mode, the mattress 28 can be effortlessly rotated in a horizontal plane once the air pump 127 (FIG. 3) is turned on to fill and continue to feed the expandable air column with air creating a levitation effect. Once the mattress 28 has been rotated to the desired position, the cover 22 is attached to the mattress 28 causing its non-slick side to be contact with the box spring 30.

Figure 17:
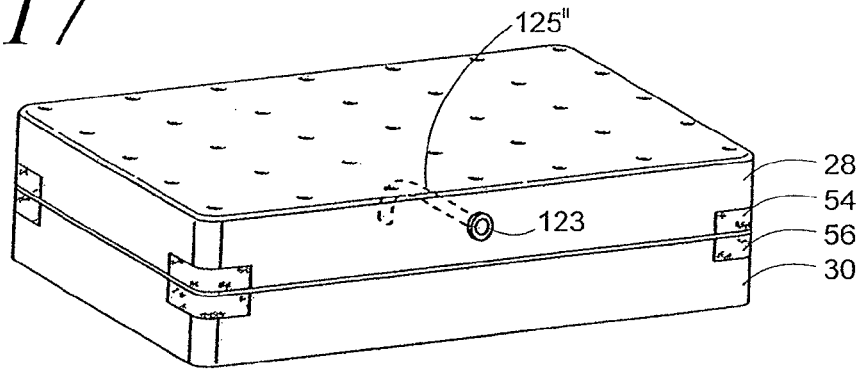
FIG. 17 is similar to FIG. 16 but shown with the mattress placed on the box spring illustrating integrated fastener strips aligned with one another.
Figure 18:
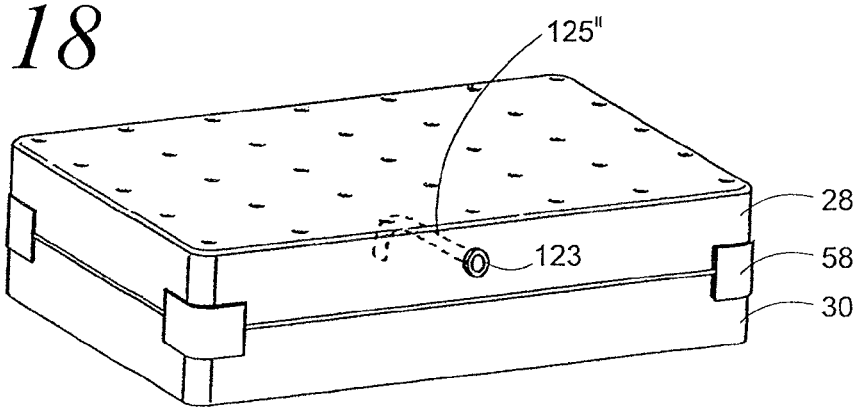
FIG. 18 is similar to FIG. 17, illustrating cooperating removable fastener strips attached to the integrated fastener strips in order to secure the mattress to the box spring.

In addition to the embodiments discussed above which require two covers, alternate embodiments are discussed below in which one or both of the covers 120 and 22 are integrally formed in the mattress or box spring 30, respectively. For example, as illustrated in FIGS. 16-18, one or both of the covers 120 and 22 may be eliminated and integrally formed in the mattress 28 or box spring 30. For example, assume that the cover 120 is integrally formed on the underside of the mattress 28. In this embodiment, the cover 22 is attached to the boxes spring 30 so that its non-slick surface is in contact with the box spring 30 and its slick surface faces upwardly in a rotate mode of operation. Once the mattress is rotated to the desired position, the cover 22 is attached to the mattress 28 so that its rough surface is in contact with the box spring 30 and its slick surface is in contact with the slick surfaces 121 and 124 of the cover 120 in a normal mode of operation.

Alternatively, as illustrated in FIGS. 16-18, both covers 120' and 22' can be integrally formed in the mattress 28 and box spring 30, respectively with their respective slick surfaces in constant contact. In this embodiment, the slick surfaces 121' and 124' of the cover 120' and the slick surface of the cover 22' is attached to the underside of the mattress 28 such that the slick surface faces downwardly and the non-slick surface is in contact with the underside of the mattress 28. In a rotate mode of operation, the slick surface of the cover 120' is in contact with the slick surface integrally formed in the box spring 30.

Figure 19:
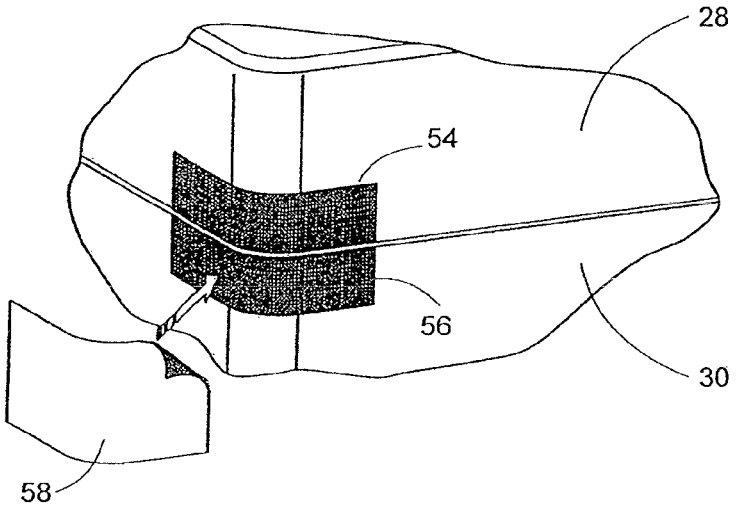
FIG. 19 is a partial elevational view illustrating one corner of a mattress disposed on a box spring illustrating integrated fastener strips aligned on each of the box spring and mattress, shown with a cooperating removable fastener strip removed.
Figure 20:
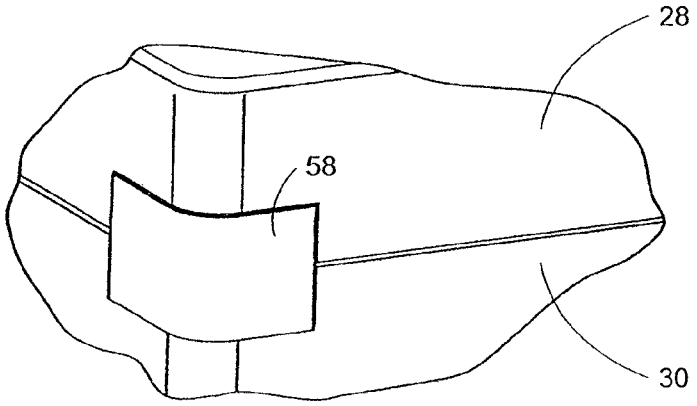
FIG. 20 is similar to FIG. 19 but shown with the removable fastener strip attached to the integrated fastener strips on the mattress and box spring.

In order to prevent movement of the mattress 28 with respect to the box spring 30 in a normal mode of operation, fasteners, for example, Velcro fasteners, may be provided on the corners of both the mattress 28 and the box spring 30. In particular, permanent fastener strips 54 are provided on the corners of the mattress 28, as shown in FIGS. 16, 17 and 19. Similarly, permanent fastener strips 56 are provided on the corners of the box spring 30. As shown in FIGS. 17 and 19, when the mattress 28 is correctly aligned with the box spring 30, the permanent fastener strips 54 on the mattress 28 are aligned with the permanent fastener strips 56 on the box spring 30. In order to secure the mattress 28 relative to the box spring 30, removable cooperating fastener strips 58 are selectively attached to the permanent fastener strips 54 and 56 as shown in FIGS. 18 and 20 defining a normal mode of operation. The removable fastener strips 58 are simply removed in order to rotate the mattress 28 and replaced once the mattress 28 has been rotated.

Figure 21:
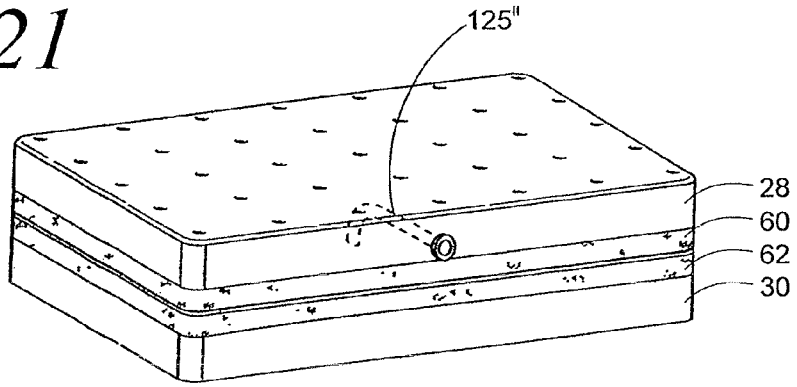
FIG. 21 is an isometric view of an alternative fastener configuration for securing the mattress to the box spring, illustrating a mattress disposed on a box spring in which the integrated fastener is disposed around the periphery of the box spring and the mattress.
Figure 22:
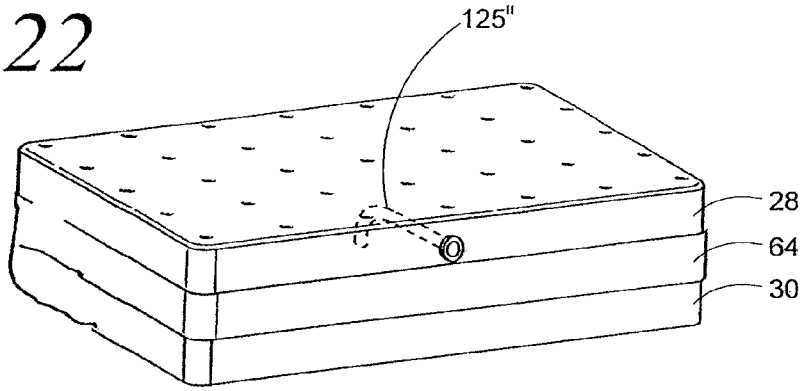
FIG. 22 is similar to FIG. 21 but shown with a cooperating removable fastener strip attached to the integrated fastener strips on the mattress and the box spring.
Figure 23:
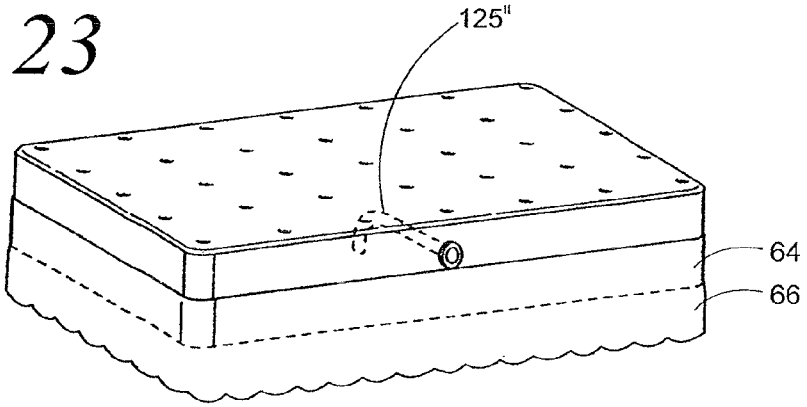
FIG. 23 is similar to FIG. 22 but illustrating a bed skirt which incorporates a removable fastening strip attached to the integrated fastening strips on the mattress and box spring.

Two alternate embodiments are illustrated in FIGS. 21-23. In the embodiment illustrated in FIGS. 21 and 22, permanent fastener strips 60 and 62 are located around the peripheries of the mattress 28 and the box spring 30, adjacent to the edges where the mattress 28 and the box spring 30 come together. As shown in FIG. 22, a cooperating removable fastener strip 64 is attached to the permanent fastener strips 60 and 62 on the mattress 28 and box spring 30, respectively. In yet another alternate embodiment as shown in FIG. 23, the cooperating removable fastener strip 64 may be affixed to the inside of a bed skirt 66. With such a configuration, not only are the mattress 28 and box spring 30 secured together, the configuration also allows a bed skirt 66 to be easily installed.

Figure 26:
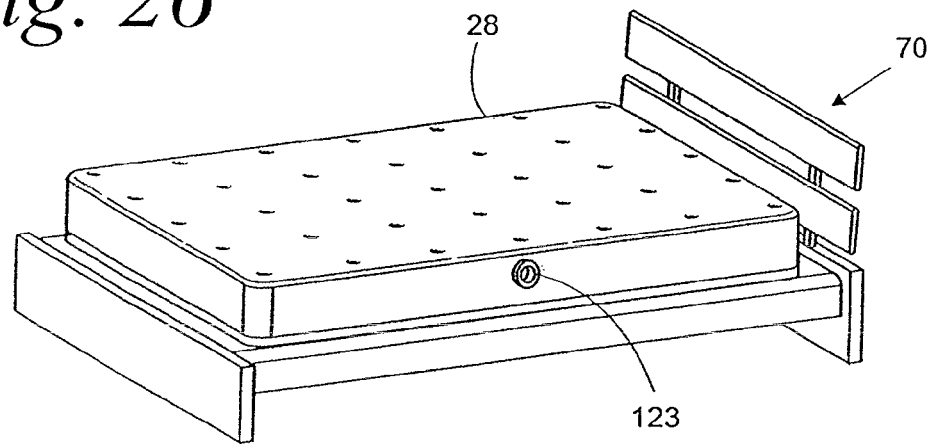
FIG. 26 is similar to FIG. 25 but illustrating a cover in accordance with the present invention installed on a platform forming a platform bed.
Figure 27:
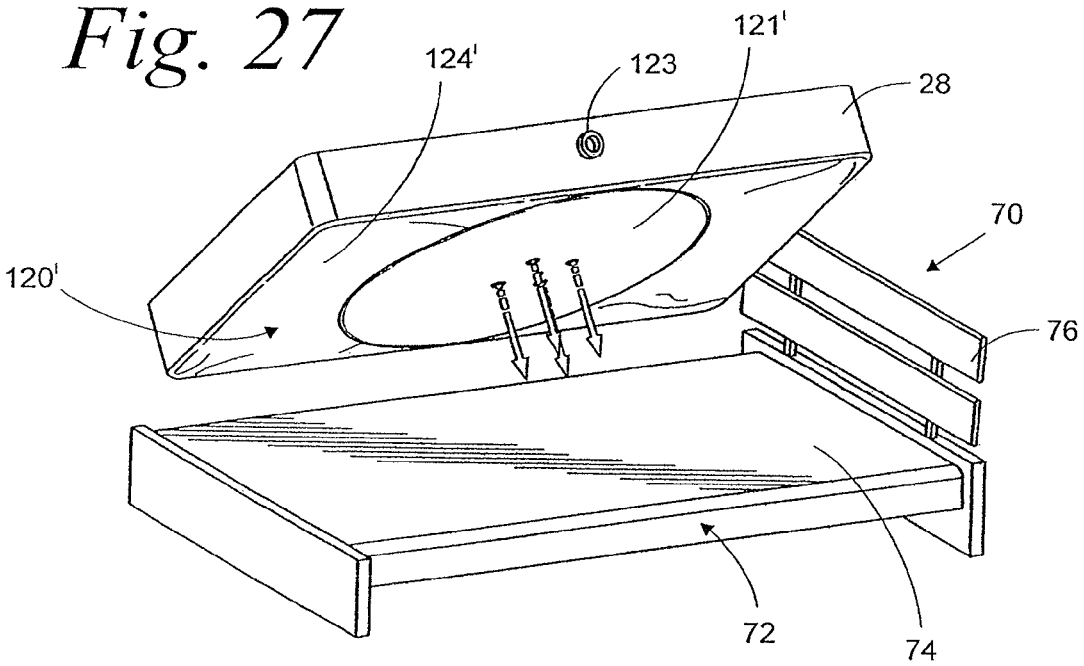
FIG. 27 is similar to FIG. 26 but showing the mattress with the cover in accordance with the present invention lifted from the platform.

FIGS. 26 and 27 illustrate an application of the invention on a platform bed, generally identified with the reference numeral 70. In this embodiment, the cover 120' is incorporated on the underside of a mattress 28. with the intake nozzle 123 terminated to one edge of the mattress 28. In this embodiment, the mattress 28 sits directly on a platform 72, which is formed with a slick surface 74 which cooperates with the slick surfaces 121' and 124' of the cover 120'. In a rotate mode of operation, air from an air supply (not shown) is applied to the intake nozzle 123 which causes the mattress 28 to levitate. A headboard 76 is removed from the platform 74 and the mattress 28 is rotated to its desired position. The air supply is then removed and the mattress returns to a rest position on the platform 72 and the headboard 76 is replaced in a normal mode. The mattress 28 is then secured to the platform 74 by a conventional fastener system.

Obviously, many modifications and variations of the present invention are possible in light of the above teachings. For example, the present invention can be utilized with only the cover 120. In this embodiment, the invention relies on the surface of the box spring 30 to cooperate with the levitation device. Also, the cover 22 can be provided with either two (2) slick sides or a slick side and a non-slick side. Thus, it is to be understood that, within the scope of the appended claims, the invention may be practiced otherwise than as specifically described above.

I claim:

1. A method for levitating a mattress supported on a box spring or platform, the method comprising the steps of: (a) securing an expandable volume formed from two layers of material attached together having one or more attachment points for attaching said two layers of material together in one or more locations and an air intake and at least one air exit hole between said mattress or box spring or platform, said expandable volume having a rotate mode and a normal mode; (b) expanding said expandable air volume disposed between said mattress and said box spring or platform in said rotate mode of operation; (c) levitating said mattress; (d) subsequently allowing said air in said expandable volume to be discharged.

2. A method for levitating a mattress supported on a box spring or platform, the method comprising the steps of: (a) expanding an expandable air volume formed from two layers of material attached together having one or more attachment points for attaching said two layers of material together in one or more locations and an air intake and at least one discharge hole (b) levitating said mattress in a horizontal plane to a desired position; (c) allowing said air in said expandable volume to be discharged.

3. A method for levitating a mattress supported on a box spring or platform, wherein an expandable air volume formed from two layers of material attached together having one or more attachment points for attaching said two layers of material together in one or more locations and an air intake and at least one air discharge hole is disposed between such mattress and said box spring or platform; the method comprising the steps of: (a) expanding said expandable air volume in order to levitate said mattress; (b) allowing said air in said expandable volume to be discharged after said mattress has been levitated.

* * * * *